United States Patent [19]

Aubry

[11] Patent Number: 4,917,417

[45] Date of Patent: Apr. 17, 1990

[54] HOOD LATCH ASSEMBLY HAVING UNITARY LATCHING LEVER WHICH FUNCTIONS BOTH AS A PRIMARY AND SECONDARY LATCH

[75] Inventor: Michael E. Aubry, Utica, Mich.

[73] Assignee: General Motors Corporation, Detroit, Mich.

[21] Appl. No.: 315,081

[22] Filed: Feb. 24, 1989

[51] Int. Cl.[4] ..... E05C 19/10

[52] U.S. Cl. ..... 292/117; 292/125; 292/DIG. 14

[58] Field of Search ..... 292/117, 116, 120, 121, 292/125, 128, D14

[56] References Cited

U.S. PATENT DOCUMENTS

| | | | |
|---|---|---|---|
| 2,246,789 | 6/1941 | Dall | 292/117 |
| 2,268,741 | 1/1942 | Dall | 292/117 |
| 2,715,538 | 8/1955 | Janonis | 292/DIG. 14 |
| 2,793,061 | 5/1957 | Dall | 292/DIG. 14 |
| 2,808,280 | 10/1957 | Ragsdale | 292/DIG. 14 |
| 2,924,473 | 2/1960 | Krause | 292/DIG. 14 |
| 3,003,800 | 10/1961 | Hammond | 292/DIG. 14 |

*Primary Examiner*—Richard E. Moore
*Assistant Examiner*—Michael J. Milano
*Attorney, Agent, or Firm*—William A. Schuetz

[57] ABSTRACT

A compact, relatively simple hood latch assembly for latching and unlatching a hood of an automotive vehicle is provided in which all the components can be housed in a single housing and which includes only a single pivotal latching lever for providing both a primary latch and a secondary latch.

7 Claims, 3 Drawing Sheets

HOOD LATCH ASSEMBLY HAVING UNITARY LATCHING LEVER WHICH FUNCTIONS BOTH AS A PRIMARY AND SECONDARY LATCH

The present invention relates to a hood-latch assembly for latching and unlatching a hood of an automotive vehicle and, more particularly, to a hood latch assembly which can be preassembled as a unit and which includes a unitary pivotal latching lever which functions both as a primary and secondary latch.

In automotive vehicles having an engine compartment hood which can be moved between an open position to permit access to the engine compartment and a closed position against vehicle body structure to close off access to the engine compartment, it is common to provide a hood latch assembly for latching the hood in its closed position, but which can be unlatched to permit the hood to be moved to its open position. One common type of hood latch assembly for latching and unlatching a striker carried by the hood includes a primary latch for latching the hood in its closed position, a cable release pullable from inside the vehicle to move the primary latch to an unlatched position, a pop-up spring to move the hood to a pop-up position in which the striker engages a secondary latch. The secondary latch is provided as a safety feature should the primary latch release the hood so that the hood cannot fly open while the vehicle is being operated. The secondary latch can be manually manipulated through access at the front of the vehicle to allow the hood to be unlatched from its pop-up position and moved towards its open position.

The present invention provides a novel hood latch assembly of the type noted above, but in which all the operative parts can be preassembled in a single housing and then the housing readily assembled to support structure on the automotive vehicle.

The present invention further provides a novel hood latch assembly having a primary latch, secondary latch and pop-up spring means which are all contained in a single housing and which is of a simple and economical construction.

The present invention additionally provides a novel hood latch assembly wherein a single or unitary lever is provided which functions as both the primary latch when the hood is in its closed position and as a secondary latch when the hood is released and moved to its pop-up position by the pop-up spring means.

The present invention still further provides a novel hood latch assembly which can be readily preassembled as a unit without the need for any welding or special fasteners and then readily mounted on the vehicle body structure.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
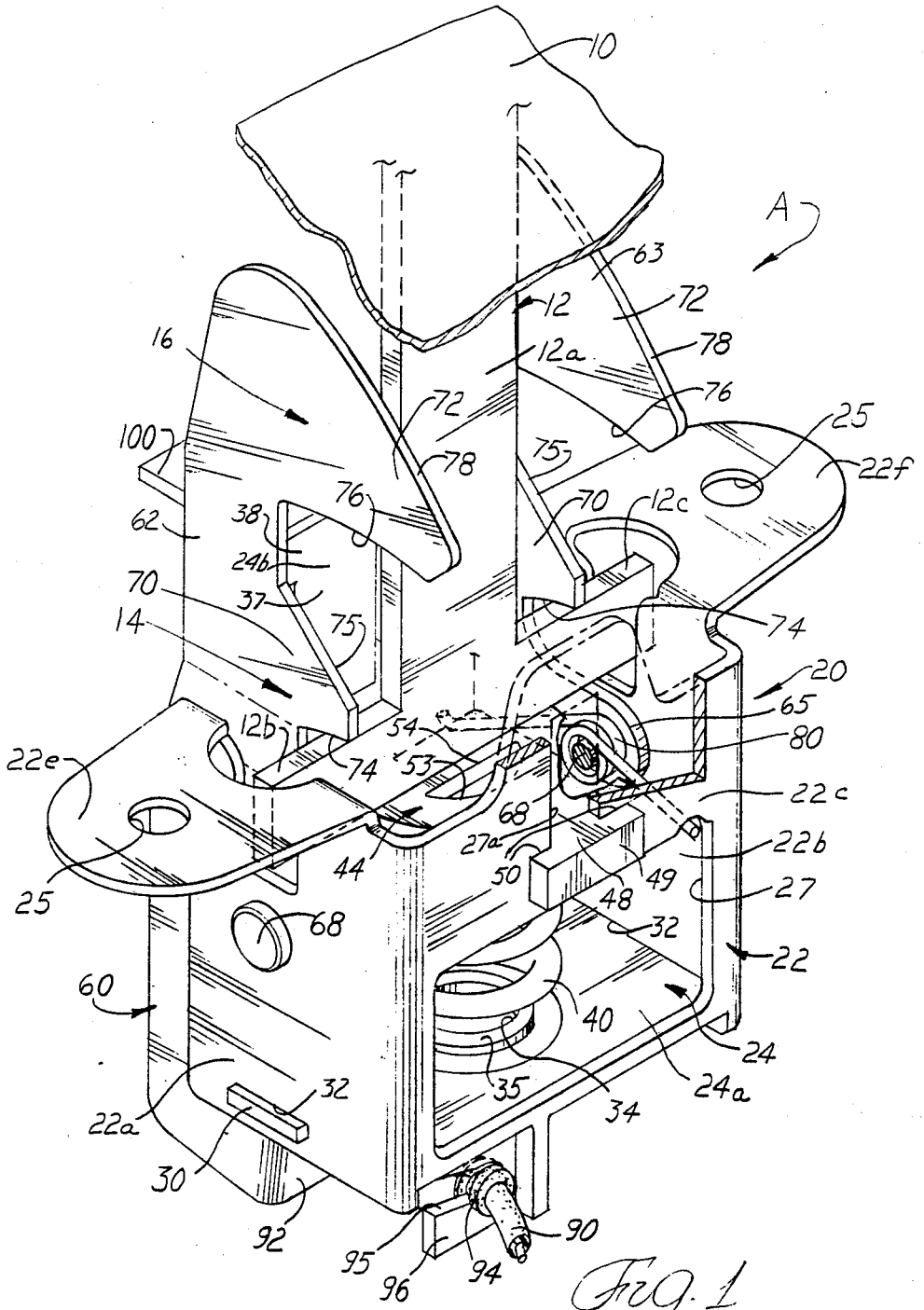
FIG. 1 is a fragmentary perspective view of the novel hood latch of the present invention and showing the parts thereof in their relative positions in which a striker carried by a hood is latched in its closed position.
Figure 2:
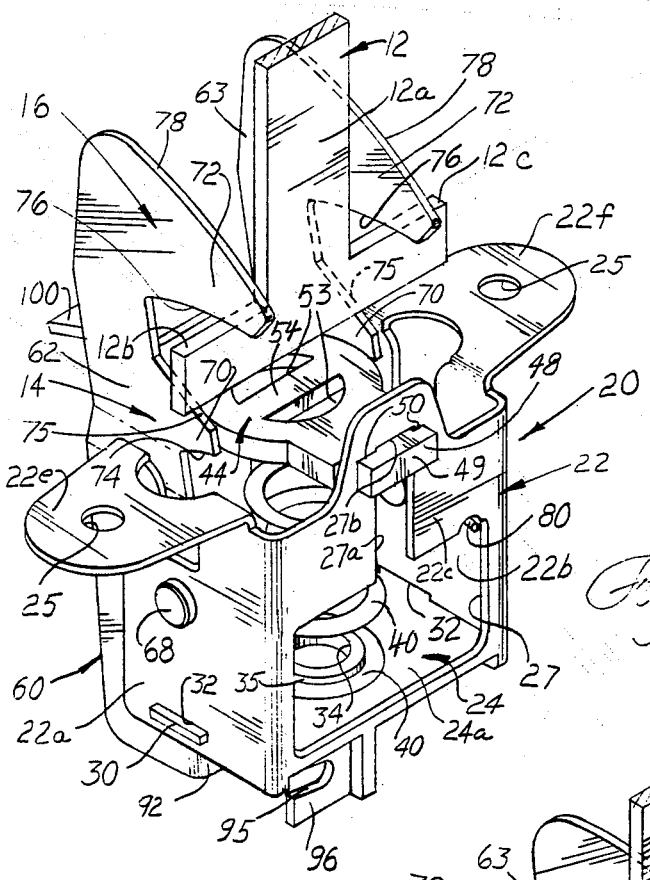
FIG. 2 is a reduced perspective view like that shown in FIG. 1, but showing the position of the parts of the novel hood latch assembly when the hood and striker are in their pop-up position.
Figure 3:
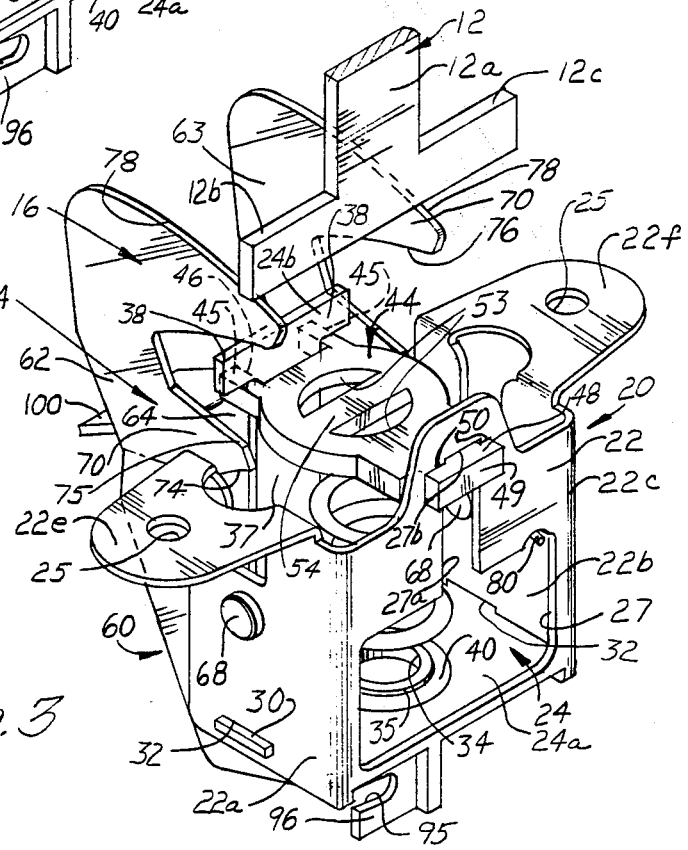
FIG. 3 is a perspective view like that shown in FIG. 2, but showing the relative position of the parts of the hood latch assembly when the hood and striker are free from the latch assembly.

The present invention provides a novel hood latch assembly A for latching and unlatching a hood 10 of an automotive vehicle (not shown). The hood 10 on its underside carries a downwardly, generally vertically disposed striker 12. The striker 12 is hereshown as comprising a planar inverted T-shaped member having a downwardly extending stem **12*a* and a pair of transverse flanges or bars 12*b* and 12*c* whose upper sides define latch engaging surfaces. The hood 10 would be pivotally mounted on the vehicle for movement between a closed position, as shown in FIG. 1, in which the hood latch assembly A is latched to the striker 12 by a primary latching means 14, a partially open or pop-up position, as shown in FIG. 2, in which the hood 10 and striker 12 would be latched by a secondary latching means 16 and a fully open position, as shown in FIG. 3, in which the striker 12** would not be latched to the hood latch assembly A.

Figure 4:
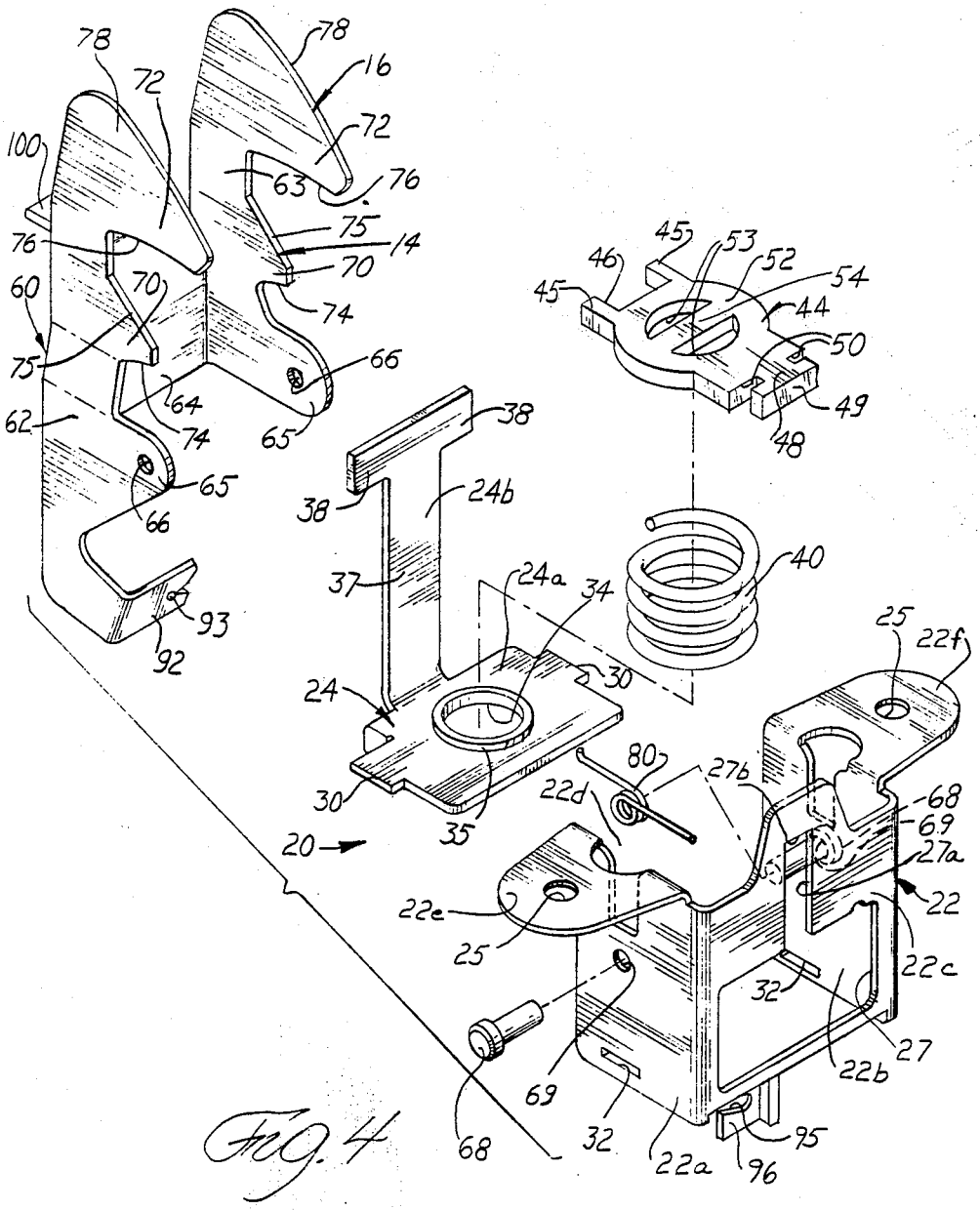
FIG. 4 is an exploded view of the novel hood latch assembly shown in FIG. 1.

The hood latch assembly A comprises a stationary housing 20 for housing all the components of the hood latch assembly A. The housing 20 comprises a first or main housing member 22 and a secondary housing member 24, both of which are stamped from a suitable sheet metal, such as steel, to the configuration as shown in FIG. 4. The main housing member 22 is generally U-shaped to define a pair of side walls **22*a* and 22*b*, a front wall 22*c* and an open back 22*d*. The housing member 22 also includes a pair of flanges 22*e* and 22*f* which extend outwardly and are perpendicular to the side walls 22*a* and 22*b*, respectively, at the upper end of the latter. The flanges 22*e* and 22*f* each have an opening 25 therethrough in order to enable the housing assembly A to be bolted on a vehicle support structure (not shown) adjacent the front end of the hood 10 upon the housing 22 being received within a suitable recess in the support structure. The front 22*c* of the housing member 22 has an inverted T-shaped slot 27 therethrough. The slot 27 includes an upwardly extending rectangularly shaped portion 27*a* which functions as a guide slot, as will be here fully described. The front 22*c* at the upper end of the slot portion 27*a* defines a stop surface 27*b*** and for a reason to be hereinafter more fully described.

The secondary housing member 24 is generally L-shaped and comprises a base **24*a* which is of a generally rectangular shape and an upstanding T-shaped portion 24*b* which extends normal to the base 24*a* at one side thereof. The base 24*a* has a pair of ears or tabs 30 at its opposite sides which are adapted to be received within slots 32 in the sides 22*a* and 22*b* of the housing member 22. The housing member 24 is connected to the housing member 22 by force fitting the ears 30 on the base 24*a* between the sides 22*a* and 22*b* of the housing member 22 until the ears are received within the slots 32 whereupon the sides 22*a* and 22*b*, which can be slightly deflected, will spring back to lock the base 24*a* in place on the housing member 22, as shown in FIGS. 1–3. The base 24a also has a central through opening 34 surrounded by an upwardly extending lip 35. The T-shaped portion 24b includes a stem 37 which functions as a guide and horizontally extending portions 38 which serves as a stop, and in a manner to be hereinafter more fully described. The T-shaped portion 24b is of a lesser width than the back 22d of the housing member 22 and partially forms a rear wall for the housing member 22** when connected thereto.

The latch assembly A further includes a pop-up spring 40 which is adapted to be secured to the base 24a of the housing member 24 and which extends upwardly within the housing 20. The pop-up spring 40 is in the form of a coiled compression spring having its lowermost annular portion or coil secured to the base portion 24a by curling and crimping the lip 35 thereover.

The compression spring 40 at its upper end is adapted to abuttingly engage a striker engaging slide 44, preferably made from a suitable metal or hard plastic material. The slide 44 is adapted to be slidably supported by the housing 20 for vertical movement relative thereto. To this end, the slide 44 at its left end, as viewed in FIG. 4, has a pair of spaced projections 45 defining an intermediate slot 46. The slide 44 at its other end is T-shaped, as indicated by reference numeral 48, to define a head 49 and a pair of slots 50. The slide 44 is adapted to be slidably connected to the housing 20 by positioning the slide 44 so that its projections 45 straddle the stem 37 of the T-shaped portion 24b and then, after the spring 40 is compressed downwardly, by having the slots 50 of the end 48 of the slide 44 receive the front 22c of the housing member 22 adjacent its sides defining the slot portion 27a. The head 49 of the T-shaped portion 48 will engage the front side of the front 22c of the housing member 22 and the remainder of the slide 44 will engage the back side thereof. It should be apparent that when the slide 44 is thus connected to the housing 20 that it cannot move sidewise or fore and aft of the housing 20, but is freely movable or slidable vertically relative thereto. The pop-up spring 40 functions to bias the slide upwardly and the stop 27b on the housing member 22 and the stop defined by the portions 38 of the T-shaped portion 24b of the housing member 24.

The slide 44 has a generally circular shaped midportion for engaging the upper end of the pop-up springs 40 and is provided with a pair of semi-circular slots 53 which are spaced apart by a bridge portion 54. The striker is adapted to engage the bridge portion 54 and the slots 53 are provided to enable the slide 44 to be more readily assembled or disassembled from the housing 20 via the aid of a suitable tool.

The novel latch assembly A further includes a single, one-piece or unitary latching lever 60 which is adapted to be pivotally supported by the housing 20 and which functions both as the primary latch or latching means 14 and as the secondary latch or latching means 16. The lever 60 is stamped from suitable sheet metal and has a generally U-shaped configuration to define a pair of sides 62, 63 and a bottom 64. The sides 62 and 63 extend perpendicular to the bottom 64 and each has an ear 65 adjacent its lower end provided with a through opening 66 and with the openings 66 being aligned with each other.

The latching lever 60 is adapted to be pivotally connected to the housing member 22 of the housing 20 via pivot pin means 68 which extend through aligned openings 69 in the sides 22a and 22b of the housing member 22. By positioning the latching lever 60 so that the openings 66 in the ears 65 are in alignment with the openings 69 in the housing member 22 and then inserting the pivot pin means 68 therethrough and suitably securing the pins 68 against axial movement, the lever 60 will be pivotally supported for movement into and out of the path of movement of the striker 12 or toward and from the front wall 22c of the housing 22. Note that the latching lever 60 surrounds the T-shaped portion 24b of the housing member 24 but that its pivotal connection is such that the bottom 64 is spaced rearwardly from the T-shaped portion 24b so as to allow the latching lever 60 to pivot relative to the housing 20.

The latching lever 60 also includes the primary latching means or latch 14 and the secondary latching means or latch 16. The primary latch 14 comprises latching ears or projections 70 integral with each side 62, 63 and coplanar with the sides 62 and 63. The latching ears 70 extend toward the front side 22c of the housing 22 a predetermined distance and each ear 70 has a generally planar underside 74 for engaging the striker 12 and a downwardly inclined tapered upper side 75 which forms a cam surface for the striker 12. The secondary latching means or latch 16 comprises latching ears or projections 72 integral with each side 62, 63 and coplanar with the side walls 62, 63. The latching ears 72 face toward the front wall 22c of the housing 22, but extend toward the front wall 22c a further extent than do the latching ears 70. The latching ears 72 are located a given distance above the latching ears 70 so that the respective pairs of latch ears 70 and 72 are vertically spaced. The ears 72 also have an underside 76 for engaging the striker 12 and a tapered upper side 78 which is downwardly inclined toward the front 22c of the housing member 22 and which defines a cam surface for engaging the striker 12.

The latching lever 60 is adapted to be biased toward a first or fully latched position, as shown in FIG. 1, in which both the latching ears 70, 72 are disposed within the path of movement of the striker 12 by a torsion spring 80. The torsion spring 80 encircles the pivot 68 secured to the side wall 22b of the housing member 22 and has one end in operative engagement with the front side 22c of the housing member 22 along its surface defining the slot 27 and has its other end in operative engagement with the underside of the bottom 64 of the latch lever 60.

The latch lever is adapted to be moved from its latched position, as shown in FIG. 1, toward a first unlatched position, as shown in FIG. 2, in which the striker 12 is released from engagement with the underside 74 of the latching ears 70 by a cable release means 90. The cable release means 90 would be connected at one end to a handle adjacent the dashboard of the vehicle (not shown) to enable the operator to pull on the cable release means 90 and at its other end operatively connected with a leg 92 integral with the side wall 62 of the latch lever 60. The cable release 90 would be knotted at the other end and be force fittingly received within a slot 93 on the leg 92 so that the knot (not shown) would engage the back side of the leg 92. The cable release would also be slidably supported via a ferrule 94 which is adapted to be force fittingly received within a slot 95 on a downwardly extending flange 96 adjacent the front end 22c of the housing member 22. By pulling on the cable release 90, the latch lever 60 would be pivoted in a counterclockwise direction, as viewed in the drawings, and in opposition to the biasing force of its torsion spring 80 to effect release of the striker 12 from the ears 70 of the latch lever 60. Preferably, the cable release would have a stop or second knot (not shown) on it to limit the extent of pulling movement that can be exerted thereon so that only the ears 70 are released from the striker 12 but not the ears 72, which extend a further extent into the path of the movement of the striker 12. As is well known in the art, the cable release 90 adjacent the dashboard will have a return spring (not shown) to return the handle and the cable towards its original position when the handle of the cable release 90 is released.

The operation of the novel hood latch assembly A will now be described. When the hood 10 is in its closed position, as shown in FIG. 1, the striker 12 is fully received within the housing 20 and is engaged with the undersides 74 of the latching ears 70 of the latch lever 60. In this position, the pop-up spring 40 is compressed and at the slide 44, which is in engagement with the underside of the striker 12, is in the position shown in FIG. 1 in which it is located adjacent the lower end of the slot portion 27*a*.

When the operator desires to move the hood 10 to its open position, he will merely pull on the cable release means 90 which has a limited travel and cause the latch lever 60 to be pivoted in a counterclockwise direction, as viewed in the drawings. As the latch lever 60 is pivoted in a counterclockwise direction, the underside of the ears 70 of the primary latch 14 will become disengaged from the striker bars 12*b* and 12*c* whereupon the pop-up spring 40 will immediately move the slide 44, striker 12 and the hood 10 vertically upwardly until the striker bars 12*b* and 12*c* engage the undersides 76 of the latching ears 72 of the secondary latch 16. In this position, the hood 10 will be partially open or in its pop-up position and the slide 44 will be adjacent the stops 27*b* and 38. The provision of the latch ears 72 of the secondary latch provides a safety feature in that should the hood 10 be allowed to be moved towards its open position by accidental release of the latching ears 70, the hood 10 cannot fly all the way open and obstruct a driver's vision.

When the hood 10 has been moved to its pop-open position, it can thereafter be moved to its fully open position by further pivotal movement of the latching lever 60 in a counterclockwise direction, as viewed in the drawings. This is manually done via access in the front of the vehicle and with the operator manually engaging a tab or handle 100 connected to the bottom 64 of the latch lever 60. When the striker bars 12*b* and 12*c* are disengaged from the undersides 76 of the latch ears 72, the hood 10 can be moved towards its open position.

When it is desired to move the hood 10 toward its closed position, the operator need merely move the hood 10 towards its closed position. As the hood 10 moves toward its closed position, the path of movement of the striker 12 is such that the bars 12*b* and 12*c* thereof will first engage the latching ears 72 of the latch lever 60 along their top tapered sides 78. Further movement of the hood 10 towards it closed position will cause the latch lever 60 to be cammed in a counterclockwise direction in opposition to the biasing force of the torsion spring 80 until the ears 72 are moved out of the way of the striker 12 whereupon the torsion spring 80 will return the latch lever 60 in a clockwise direction to hook the ears 72 over the bars 12*b* and 12*c* of the striker 12. Further downward movement will cause the striker 12 to engage the inclined cam surfaces 75 on the primary latch ears 70 to cause the lever 60 to again be pivotally moved in opposition to the biasing force of the torsion spring 80 until the latch ears 70 clear the striker 12. When this occurs, the torsion spring 80 will return the latch lever 60 clockwise toward its latching position, as shown in FIG. 1, in which the ears 70 will hook over and engage the top sides of the bars 12*b* and 12*c* of the latch lever 60. During downward movement of the striker 12 toward its fully latched position, as shown in FIG. 1, the slide 44 is engaged by the striker 12 and moved downwardly to compress the pop-up spring 40 so that the latter is able again to pop-up the hood 10 when the primary latch 16 is released from the striker 12.

From the foregoing, it should be apparent that a novel hood latch assembly A has been provided which is of a relatively simple, compact and economical construction, which can be readily attached as a unit to a vehicle support structure adjacent the front end of the hood and wherein the latch assembly A includes only a single latch lever for providing both the primary and secondary latching functions for the hood.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A hood latch assembly for use in an automotive vehicle having a hood pivotally supported for movement between open, partially open and closed positions, a striker having a horizontally disposed latch engaging portion carried by said hood, and with said striker being movable through a given path of movement by said hood when the latter is moved between its open and closed positions and a generally horizontally disposed vehicle support structure for engaging said hood when in its closed position, said hood latch assembly comprising:

a stationary housing which is adapted to be mounted to said support structure and which receives said striker when the hood is moved to its partially open and closed positions, primary latch means pivotally supported by said housing for movement toward and from the path of movement of said striker between a latched position in which it engages said latch engaging portion on said striker to hold the hood in its closed position and an unlatched position in which it permits movement of the hood to a partially open position, manually manipulatable secondary latch means pivotally supported by said housing for movement toward and from said path of movement of said striker between a latched position in which it overlies and engages said latch engaging portion of said striker when the hood is moved to a partially open position and an unlatched position in which it permits movement of said hood from its partially open position to its fully open position, first spring means for biasing said primary and secondary latch means toward their latched positions, second pop-up spring means carried by said housing and engageable with said striker when the hood is moved to its closed position, the pop-up spring means being compressed by said striker when the hood is moved to its closed position, and a release means operatively connected with said primary latch means for effecting movement of the latter to its unlatched position to allow the pop-up spring means to move the hood to its partially open position in which the striker engages the secondary latch means, the improvement being that said primary and secondary latch means comprises a unitary latch lever pivotally supported by said housing via a pivot means and having first and second vertically spaced, transversely extending latching projections lying in the path of movement of said striker, said first latching projection serving as said primary latching means and said second latching projection serving as said secondary latching means and extending transversely of and projecting into the path of movement of said striker a greater extent than said first latching projection, and wherein said first and second latching projections of said latch lever have tapered upper end surfaces to enable the striker to cam the unitary latch lever toward their unlatched position in opposition to said first spring means when the hood is being moved from its open position to its partially open and closed positions, respectively, said first spring means returning said unitary latch lever to its latched position when the striker clears the first and second latching positions of said latching lever as the hood is being moved toward its closed position.

2. A hood latch assembly, as defined in claim 1, and wherein said release means is operatively connected with the unitary latch lever adjacent its end remote from said first and second latching projections and only allows limited pivotal movement of said latching lever by said release means to an extent sufficient to disengage said first latching projection from said striker, but not said second latching projection.

3. A hood latch assembly as defined in claim 2, and wherein said first spring means comprises a single torsion spring surrounding said pivot means for said latching lever and has one end thereof in operative engagement with said latching lever and its other end in operative engagement with said stationary housing.

4. A hood latch assembly, as defined in claim 3, and wherein said striker comprises an inverted T-shaped planar member, wherein said latching lever comprises a generally U-shaped member, having a bottom and a pair of spaced sides each of which is shaped to define first and second vertically spaced latching projections for engaging opposite sides of said inverted T-shaped striker, and wherein the bottom of said latching member has an integral transversely extending tab which can be manually grasped to enable the latching lever to be manually pivoted to its release position to release the striker from engagement with the latching lever.

5. A hood latch assembly, as defined in claim 4, and wherein said stationary housing comprises a generally U-shaped housing member having a front side provided with a vertically extending slot, a pair of spaced sides and an open back side through which the U-shaped latching lever extends and a generally L-shaped housing member defining a bottom and an upstanding T-shaped side of a lesser width than said bottom, said bottom being connected to said sides of said U-shaped housing member to define a bottom for said stationary housing and said upstanding T-shaped side being received between the sides of said U-shaped latching lever, means for securing one end of said second pop-up spring to said bottom of said L-shaped housing member, and a slide for engaging the other end of said pop-up spring, said slide having a T-shaped projection at one end which is slidably connected to said front side of said U-shaped housing member by being slidably received in said slot on said front side thereof, said slide having a notch defined by a pair of spaced projections at its other end which straddles said T-shaped side of said L-shaped housing whereby said slide can freely slide up and down in said housing, but cannot move sidewise or fore and aft when said striker engages said slide at its top side.

6. A hood latch assembly, as defined in claim 5, and wherein said latching lever has a flange to which the release means is connected.

7. A hood latch assembly, as defined in claim 6, and wherein said housing members and latching lever are of a stamped sheet metal construction and wherein all of the parts of said latch assembly are all supported and disposed within said stationary housing whereby said hood latch assembly can be preassembled as a unit.

* * * * *